United States Patent [19]

Baldwin

[11] 4,406,506

[45] Sep. 27, 1983

[54] SHIELDED COVER FOR A QUICK-RELEASE ELECTRICAL CONNECTOR

[75] Inventor: Kenneth B. Baldwin, Newbury Park, Calif.

[73] Assignee: Automation Industries, Inc., Greenwich, Conn.

[21] Appl. No.: 289,396

[22] Filed: Aug. 3, 1981

[51] Int. Cl.[3] ..... H01R 13/44; H01R 13/503

[52] U.S. Cl. ..... 339/36; 339/143 R

[58] Field of Search ..... 339/36, 143 R; 220/306, 220/254; 138/89, 96 R, 96 T

[56] References Cited

U.S. PATENT DOCUMENTS

| | | | |
|---|---|---|---|
| 2,882,509 | 4/1959 | Archer et al. | 339/36 |
| 3,258,731 | 6/1966 | Still et al. | 339/36 |
| 3,287,687 | 11/1966 | Mosher | 339/36 |

*Primary Examiner*—John McQuade
*Assistant Examiner*—Paula Austin
*Attorney, Agent, or Firm*—Francis N. Carten

[57] ABSTRACT

A cover is provided for removably locating over the open end of a generally cylindrical connector part to protect exposed electrical elements against undesirable intrusions and to shield the elements from external electromagnetic energy.

3 Claims, 2 Drawing Figures

FIG. 1.
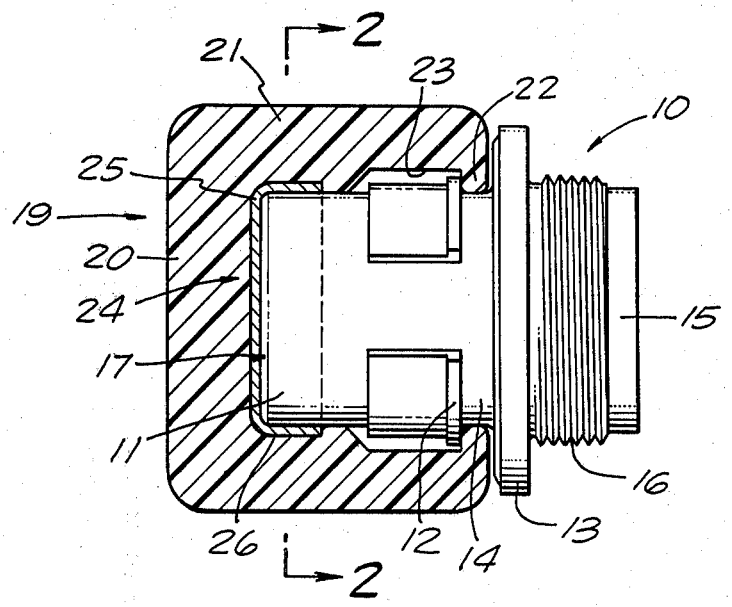
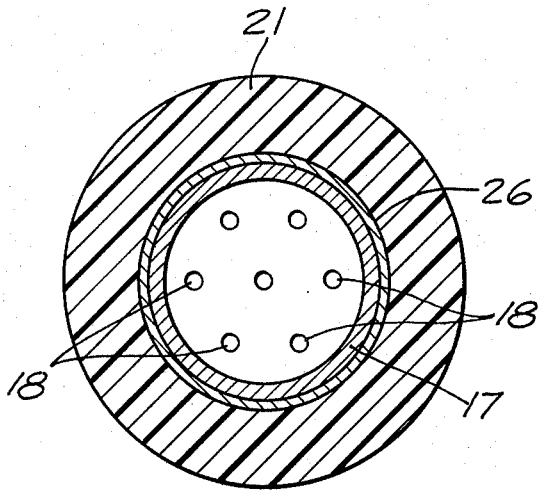
FIG. 2.

SHIELDED COVER FOR A QUICK-RELEASE ELECTRICAL CONNECTOR

The present invention relates generally to electrical connectors of the quick-release type in which receptacle and plug parts mate together forming the interconnection between a plurality of cable wires and, more particularly, to a shielded cover for locating over the exposed connector parts when they are released.

BACKGROUND OF THE INVENTION

A well known and well received quick-release connector at this time has plug and receptacle parts that are quickly and easily mated together for interconnecting cable wires to one another. When in the released condition for testing or working on the different parts of electrical apparatus to which they are connected, pins and sockets of the connector parts are exposed to contamination by moisture, dirt, dust or other foreign objects as well as the possibility of damage, such as bending of the pin contacts. In addition, when so releasd the electrical parts are exposed to pollution from external sources of radio frequency and electromagnetic interference, as well as electromagnetic pulse interference, or the possibility of themselves serving as sources of radio frequency or electromagnetic interference to other equipment.

OBJECTS OF THE PRESENT INVENTION

It is therefore a primary object and aim of this invention to provide a cover for being located over the exposed parts of a releasable electric connector when the connector parts are separated, preventing the ingress of foreign materials to the electrical parts as well as preventing radio frequency and electromagnetic interference.

DESCRIPTION OF THE DRAWING

FIG. 1 is a sectional, elevational view of the cover of this invention shown in place on a connector part.

FIG. 2 is an end elevational, sectional view taken along the line 2—2 of FIG. 1.

DESCRIPTION OF A PREFERRED EMBODIMENT

With reference now to the drawing, an electrical connector part termed a receptacle with which the cover of the present invention is especially advantageous is identified generally as at 10 and is seen to include a generally cylindrical body which in a way well known in the art intermates with appropriately dimensioned plug part of the connector for connecting cable wires together. The receptacle includes a cylindrical hub 11 with keying members 12 extending radially outward at spaced intervals about the hub circumferential periphery for keying mechanical securement during mating with a plug part. An enlarged rim 13 spaced along the hub axis from the keying members 12 serves as a limit when the connector parts are joind and defines a space or channel 14 from the keying members 12. Typically, a further cylindrical hublike member 15 extends away from the rim along the same axis as hub 11 but oppositely therefrom. The member 15 may include threads 16 or other mechanical connection means for receiving an adapter, for example. Cable wires are conventionally brought in at the outer end of 15 for internal connection to pin or socket contacts, as the case may be.

When in released condition the hub end 17 of the connector part 10 is open as shown in FIG. 2 and has a plurality of contact members 18 exposed to the surrounding atmosphere.

The cover of this invention is identified generally as at 19 and is seen to include a substantially cylindrical caplike construction having an imperforate back wall 20 and a unitary cylindrical side wall 21. An inwardly directed flange 22 on the open end has an inner diameter which is slightly less than that of the hub 11 of the connector. The inwardly directed flange has a thickness which is slightly less than the space or channel 14 between the rim 13 and the immediately adjacent surface of the keying members 12. Inwardly of the flange 22 there is a cylindrical slot 23 of such dimensions as to permit the keying members being placed therein and be radially spaced from the cover inner wall surface.

A caplike metal shield 24 has a platelike bottom 25 with continuous upstanding side walls 26. The shield is so dimensioned as to enable fitting receipt onto the outer end of the connector hub establishing a good contacting relation with the hub.

In construction, the body of the cover proper (i.e., back 20 and side wall 21) are molded from a plastic or rubber which is suitably pliable to permit a moderate amount of deformation during mounting onto a connector part. At the same time, the metal shield is encapsulated on its outer surfaces within the cover leaving its internally facing surfaces free of the plastic or rubber.

In use, the cover 19 has its open end fitted over the open end of the connector hub 11 being deformed sufficiently so that the flange 22 is snapped over the protruding keying members and fitted down into channel 14 between the keying members and enlarged flange 13. Also at this same time, the metal shield which is unitarily related to the cover body is slid over the connector part open end covering the same. Because of the internal dimensions of the cover and its inherent resiliency, the elastic force of the cover body continuously urges the metal shield onto the connector hub so that an intimate contacting relationship exists between the shield and hub end. By this arrangement not only is the open end of the connector covered and protected against the ingress of dust, dirt and moisture, or the accidental damage to connector parts contained therewithin, but also the metal shield serves to prevent radio frequency and electromagnetic interference. Although other materials may be found satisfactory for this purpose, the best results have been obtained by constructing molding the cover out of neoprene rubber and encapsulating therein a metal shield constructed of a suitable conductive metal (e.g., copper, brass, nickel plated aluminum).

I claim:

1. A shielded cover for a connector part having a hollow substantially cylindrical open-ended hub with at least one radially protruding keying member on the hub peripheral surface and an enlarged flange spaced from said keying member a predetermined amount, comprising:

a cap having an open end, an imperforate end wall and a unitarily related cylindrical sidewall;

the sidewall edge margin defining the cap open end having a continuous radially inwardly directed flange forming an open space which is dimensionally less than the cross-section dimension of the hub taken through the keying member, a groove in the inner surface of the cap cylindrical sidewall of total diameter greater than the hub cross-section dimension taken through the keying member; and metal liner means affixed to the cap end wall and having a portion extending partway along the cap sidewall, said liner being so dimensioned as to be contactingly related to the connector part hub when said cover is in place thereon.

2. A shielded cover as in claim 1, in which said cap is molded from a pliable rubber and said metal liner partially encapsulated in the cap with an outwardly directed surface free from cap material.

3. A shielded cover as in claim 1, in which the cap sidewall immediately adjacent the cap opening extends radially inward to form a flange, the dimension measured across its facing surfaces being less than the connector part hub diameter.

* * * * *